US005727530A

United States Patent [19]

Honda et al.

[11] Patent Number: 5,727,530

[45] Date of Patent: Mar. 17, 1998

[54] EVAPORATIVE FUEL-PROCESSING SYSTEM FOR INTERNAL COMBUSTION ENGINES FOR VEHICLES

[75] Inventors: Takeshi Honda; Hideki Matsumoto; Naritoshi Muramatsu, all of Wako, Japan

[73] Assignee: Honda Giken Kogyo Kabushiki Kaisha, Tokyo, Japan

[21] Appl. No.: 692,281

[22] Filed: Aug. 5, 1996

[30] Foreign Application Priority Data

Aug. 4, 1995 [JP] Japan ..... 7-218250

[51] Int. Cl.[6] ..... F02M 33/02

[52] U.S. Cl. ..... 123/520; 123/198 D; 123/519

[58] Field of Search ..... 123/516, 518, 123/519, 520, 521; 137/513.5, 513.7, 521

[56] References Cited

U.S. PATENT DOCUMENTS

| | | | |
|---|---|---|---|
| 3,057,373 | 10/1962 | Bragg | 137/521 |
| 4,117,860 | 10/1978 | Carlin | 137/513.5 |
| 4,141,380 | 2/1979 | Lenk | 137/513.5 |
| 4,727,955 | 3/1988 | Honda et al. | 123/519 |
| 4,758,141 | 7/1988 | Radermacher | 137/513.5 |
| 4,787,643 | 11/1988 | Shirata | 123/519 |
| 5,060,620 | 10/1991 | Oslapas | 123/519 |
| 5,189,877 | 3/1993 | Wells et al. | 137/513.5 |
| 5,193,512 | 3/1993 | Steinbrenner et al. | 123/519 |
| 5,224,455 | 7/1993 | Ogasawara | 123/519 |

FOREIGN PATENT DOCUMENTS 6-99748 4/1994 Japan .

*Primary Examiner*—Thomas N. Moulis

*Attorney, Agent, or Firm*—Nikaido Marmelstein Murray & Oram LLP

[57] ABSTRACT

An evaporative fuel-processing system for an internal combustion engine for use in a vehicle. A passage extends between the fuel tank and the intake passage of the engine, for guiding evaporative fuel generated in the fuel tank, for processing, and across which a canister having an air communication port is arranged. A drain passage is connected to the air communication port, to which a valve casing is connected. A first passage is connected to the valve casing, and a first valve is associated with the first passage and the valve casing, for allowing air to flow into the canister through the first passage, the valve casing and the air communication port and for inhibiting evaporative fuel from being discharged from the canister through the air communication port, the valve casing and the first passage. A second passage is connected to the valve casing, and a second valve is associated with the second passage and the valve casing, for inhibiting air from flowing into the canister through the second passage, the valve casing and the air communication port and for allowing evaporative fuel to be discharged from the canister through the air communication port, the valve casing, and the second passage. At least one of the first and second valves is bypassed.

10 Claims, 4 Drawing Sheets

EVAPORATIVE FUEL-PROCESSING SYSTEM FOR INTERNAL COMBUSTION ENGINES FOR VEHICLES

BACKGROUND OF THE INVENTION

1. Field of the Invention

This invention relates to an evaporative fuel-processing system for internal combustion engines for vehicles, which processes evaporative fuel generated in the fuel tank of the engine installed in a vehicle.

2. Prior Art

Conventionally, an internal combustion engine (hereinafter referred to as "the engine") is provided with an evaporative fuel-processing system which prevents evaporative fuel generated in the fuel tank from being emitted into the atmosphere. Generally, in the conventional evaporative fuel-processing system, a passage extends between the fuel tank and the intake passage of the engine, with one end thereof opening into the intake passage at a location downstream of a throttle valve arranged therein. Further, a canister having an air communication port, and a purge control valve are arranged across the passage extending between the fuel tank and the intake passage, in this order from the fuel tank side to the intake passage side.

Conventional evaporative fuel-processing systems of this kind include one known, for example, from Japanese Laid-Open Patent Publication (Kokai) No. 6-99748. According to the known evaporative fuel-processing system, an air communication passage is connected at one end thereof to the air communication port of the canister, the other end of which is connected via a changeover valve mechanism to a first passage and a second passage. The first passage communicates with a space at a location inwardly adjacent an upper rear portion of a rear wheel house of a chassis of a vehicle in which the engine is installed, and the second passage with a space at a location inwardly adjacent a lower rear portion of the rear wheel house.

The changeover valve mechanism is comprised of a check valve for allowing fresh air to flow through the first passage into the canister, and a check valve for allowing evaporative fuel to be discharged from the canister through the second passage.

Evaporative fuel generated in the fuel tank is temporarily adsorbed by the canister, and when the purge control valve is opened, evaporative fuel adsorbed by the canister is purged from the canister, together with fresh air introduced through the air communication passage into the canister, into the intake passage by utilizing negative pressure within the intake passage at a location downstream of the throttle valve.

The canister as mentioned above is generally arranged in the engine room of the vehicle. However, to effectively utilize a dead space within the vehicle, the canister is sometimes arranged in a recess for use as a spare wheel pan of the vehicle. Alternatively, the canister, if it has a large size according to a recent trend, is arranged in a space under a rear body etc. of the chassis since the canister cannot be accommodated in the engine room due to its large size. In such an alternative case, the first passage which is connected to the air communication port of the canister through the drain passage, is disposed to open into an upper portion of the space under the rear body, for drawing fresh and clean air from the space, and the second passage is disposed to open into a lower portion of the space under the rear body, for discharging evaporative fuel into the space.

According to the conventional evaporative fuel-processing system with the canister arranged in the space under the rear body, however, if the second passage for discharging evaporative fuel from the canister is clogged with mud etc., the pressure within the fuel tank increases so that evaporative fuel can leak through a refueling port (filler cap) of the fuel tank into the atmosphere. Further, if the first passage for allowing fresh air to flow into the canister is clogged with mud etc., fresh air cannot be introduced into the canister. Consequently, evaporative fuel stored in the canister cannot be purged into the intake passage, resulting in an increased emission of evaporative fuel through the filler cap into the atmosphere.

SUMMARY OF THE INVENTION

It is the object of the invention to provide an evaporative fuel-processing system for internal combustion engines for vehicles, which is capable of preventing emission of evaporative fuel through the filler cap of the fuel tank into the atmosphere.

To attain the above object, the present invention provides an evaporative fuel-processing system for an internal combustion engine for use in a vehicle, the engine having an intake passage, and a fuel tank, comprising:

- a passage extending between the fuel tank and the intake passage, for guiding evaporative fuel generated in the fuel tank, for processing;
- a canister arranged across the passage, the canister having an air communication port;
- a drain passage connected to the air communication port;
- a valve casing connected to the drain passage;
- a first passage connected to the valve casing;
- a first valve associated with the first passage and the valve casing, for allowing air to flow into the canister through the first passage, the valve casing and the air communication port and for inhibiting evaporative fuel from being discharged from the canister through the air communication port, the valve casing and the first passage;
- a second passage connected to the valve casing;
- a second valve associated with the second passage and the valve casing, for inhibiting air from flowing into the canister through the second passage, the valve casing and the air communication port and for allowing evaporative fuel to be discharged from the canister through the air communication port, the valve casing, and the second passage; and
- bypass means bypassing at least one of the first and second valves.

Preferably, the first and second valves each have a valve element having opposite lateral side edges, the first and second passages each having an end thereof connected to the valve casing in a fashion being opened and closed by an associated one of the first and second valves, the bypass means comprising at least one gap defined between at least one of the opposite lateral side edges of the valve element of the at least one of the first and second valves and the end of at least one of the first and second passages that is associated with the at least one of the first and second valves.

Alternatively, the first and second valves each have a valve element having opposite lateral side edges, the first and second passages each having an end thereof connected to the valve casing in a fashion being opened and closed by an associated one of the first and second valves, the bypass means comprising at least one notch formed in at least one of the opposite lateral side edges of the valve element of the at least one of the first and second valves.

Further alternatively, the first and second valves each have a valve element, the first and second passages each having an end thereof connected to the valve casing in a fashion being opened and closed by an associated one of the first and second valves, the bypass means comprising at least one hole formed through the valve element of the at least one of the first and second valves.

Alternatively, the bypass means comprises a hole formed through the valve casing and communicating an inside of the valve casing with the atmosphere or at least one bypass pipe bypassing the at least one of the first and second valves.

A typical construction of an evaporative fuel-processing system to which the invention can be applied includes a construction that the valve casing has a partition member having an opening, and first and second chambers defined therein and partitioned by the partition member, the first passage having one end thereof opening into the first chamber, the second passage having one end thereof opening into the second chamber, the first valve being arranged at the one end of the first passage, the second valve being arranged at the opening of the partition member.

The above and other objects, features, and advantages of the invention will be more apparent from the following detailed description taken in conjunction with the accompanying drawings.

DETAILED DESCRIPTION

The invention will now be described in detail with reference to drawings showing embodiments thereof.

Figure 1:
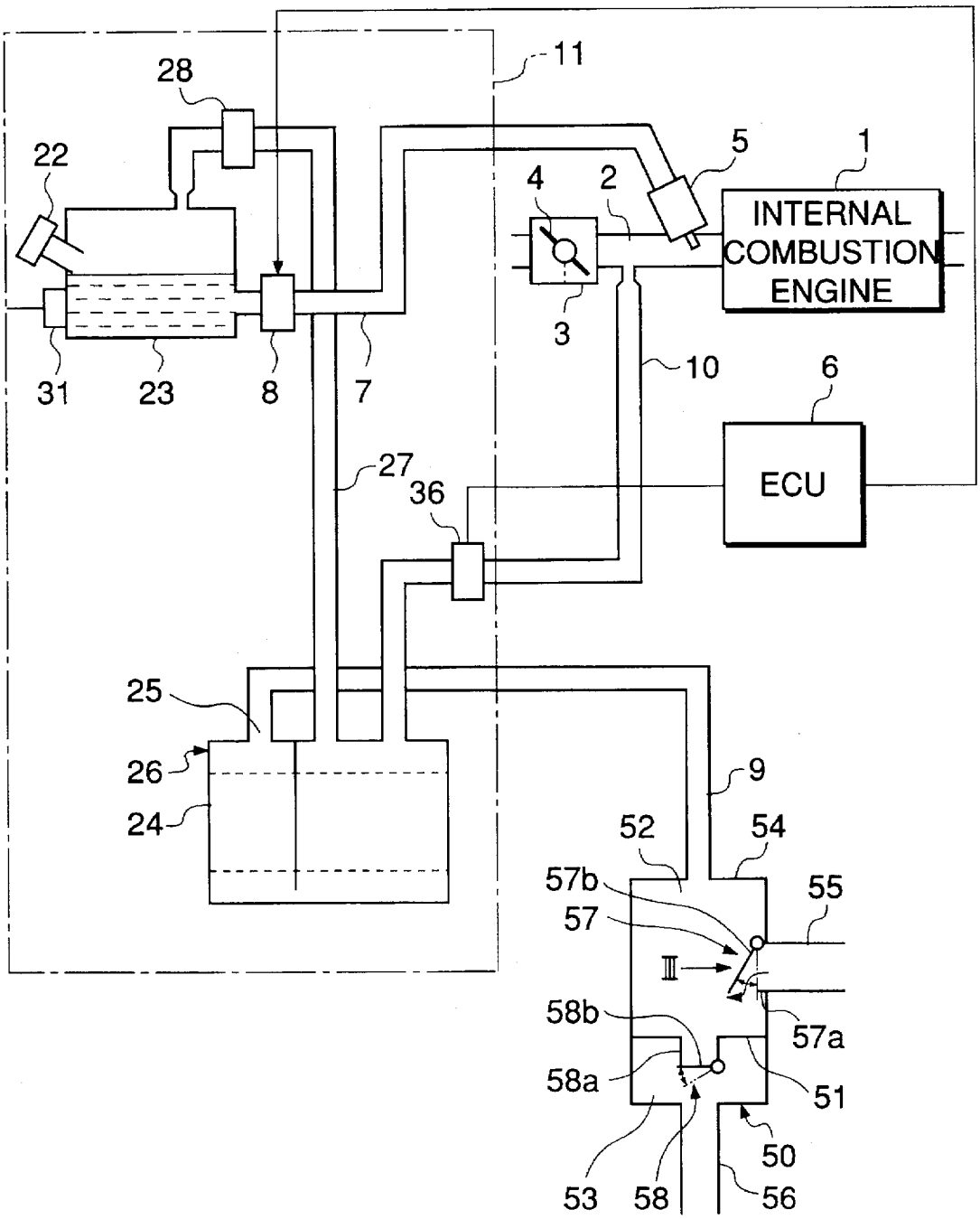
FIG. 1 is a schematic diagram showing the arrangement of an evaporative fuel-processing system for an internal combustion engine for an automotive vehicle, according to a first embodiment of the invention.

Referring first to FIG. 1, there is schematically shown the whole arrangement of an internal combustion engine and an evaporative fuel-processing system therefor, according to an embodiment of the invention. In the figure, reference numeral 1 designates an internal combustion engine (hereinafter referred to as "the engine") having, e.g. four cylinders, mounted in an automotive vehicle, not shown. The engine 1 has an intake passage 2 connected to the cylinder block thereof, across which is arranged a throttle body 3 accommodating a throttle valve 4 therein.

Fuel injection valves 5, only one of which is shown, are each inserted into the interior of the intake passage 2 at a location intermediate between the cylinder block of the engine 1 and the throttle valve 4 and slightly upstream of an intake valve, not shown. The fuel injection valves 5 are connected to a fuel pump 8 via a fuel supply pipe 7, and electrically connected to the ECU 6 to have their valve opening periods controlled by signals therefrom. A purging passage 10 opens into the intake passage 2 at a location downstream of the throttle valve 4, which is connected to an evaporative emission control system 11, referred to below.

The evaporative emission control system 11 is comprised of a fuel tank 23 having a filler cap 22 which is removed for refueling, a canister 26 accommodating activated carbon 24 therein as an adsorbent and having an air communication port 25 provided in a top wall thereof, a charging passage 27 connecting between the canister 26 and the fuel tank 23, a two-way valve 28 arranged across the charging passage 27, the purging passage 10 connecting between the canister 26 and the intake passage 2, and a purge control valve 36 arranged across the purging passage 10.

The purge control valve 36 is electrically connected to the ECU 6.

A drain passage 9 is connected to the air communication port 25 of the canister 26, across which is arranged a changeover valve mechanism 50.

The changeover valve mechanism 50 is comprised of a valve casing 54 having two chambers 52 and 53 defined therein and partitioned from each other by a partition member 51, an inlet passage 55 extending from the valve casing 54 at a location corresponding to the chamber 52, a one-way valve 57 arranged at one end of the inlet passage 55, at which the inlet passage 55 opens into the chamber, an outlet passage 56 extending from the valve casing 54 at a location corresponding to the chamber 53, and a one-way valve 58 mounted on the partition member 51 at an open projection 58*a* formed integrally thereon. The drain passage 9 communicates with the chamber 52.

Figure 2:
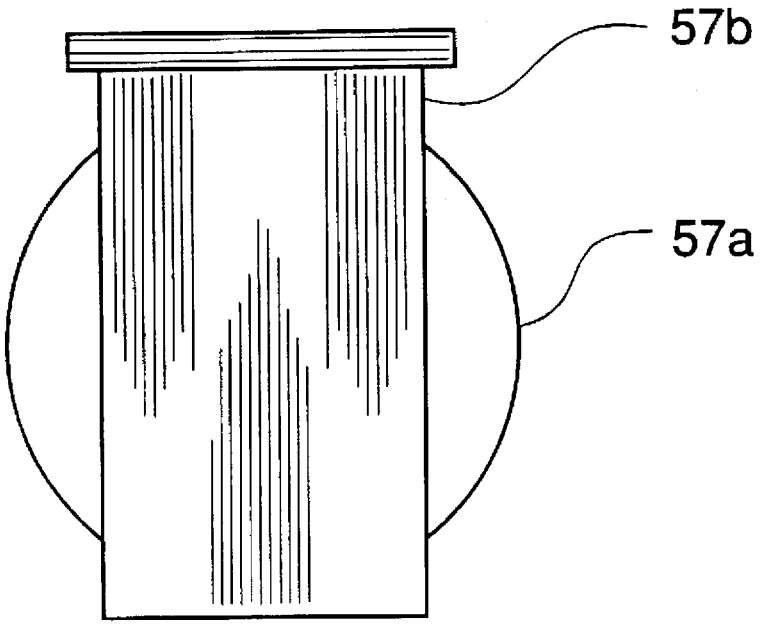
FIG. 2 is a view showing a valve element as viewed in a direction indicated by an arrow III in FIG. 1.

The one-way valve 57 is formed of an open projection 57*a* with an open end extending integrally from an end of the inlet passage 55 and projecting into the chamber 52, the projection 57*a* having a circular cross section, and a valve element 57*b* hinged to the open end of the projection 57*a*, for pivotal movement to open/close the open end of the projection 57*a* and hence the inlet passage 55. The valve element 57*b* is normally urged in a direction of closing the open projection 57*a* by a spring, not shown. Further, the valve element 57*b*, as shown in FIG. 2 which shows the open projection 57*a* and the valve element 57*b* as viewed in a direction indicated by an arrow III in FIG. 1, has a width smaller than the diameter of the open projection 57*a*. Thus, the valve element 57*b* allows part of the opening area of the open projection 57*a* to be kept open even when the valve element 57*b* is in its closed position. Alternatively, the valve element 57*b* may have a width at least equal to the diameter of the open projection 57*a* and at least one of its opposite lateral side edges notched so as to allow part of the opening area of the open projection 57*a* to be kept open even when the valve element 57*b* is in its closed position.

The one-way valve 58 is formed with the open projection 58*a* with open ends extending integrally from the partition member 51 and projecting into the chamber 53, the open projection 58*a* having a circular cross section, and a valve element 58*b* hinged at an open end of the projection 58*a*, for pivotal movement to open/close the open projection 58*a* and hence the chamber 52 with respect to the chamber 53. The valve element 58*b* is normally urged in a direction of closing the open projection 58*a* by a spring, not shown. Further, similarly to the valve element 57*b* shown in FIG. 2, the valve element 58*b* also has a width smaller than the diameter of the open projection 58*a* or at least one of its lateral side edges notches so as to allow part of the opening area of the open projection 58*a* to be kept open even when the valve element 58*b* is in its closed position.

The inlet passage 55 and the outlet passage 56 terminate at respective locations under the atmospheric pressure, referred to hereinafter. As noted above, the one-way valves 58 and 59 have the valve elements 57*a* and 58*a* biased by the springs, not shown, in directions of closing the valves, respectively. However, the valve elements 57*a* and 58*a* are disposed to open/close the respective passages 55 and 56 under opposite pressure conditions. That is, when the pressure within the passage 52 is lower than the atmospheric pressure, the one-way valve 57 opens, whereas, when the pressure within the passage 52 is higher than the atmospheric pressure, the one-way valve 58 opens. In other words, the one-way valve 57 allows air to flow into the canister 26 and inhibits evaporative fuel from being discharged from the canister 26. On the other hand, the one-way valve 58 inhibits evaporative fuel from flowing into the canister 26 and allows evaporative fuel to be discharged from the canister 26.

Figure 3:
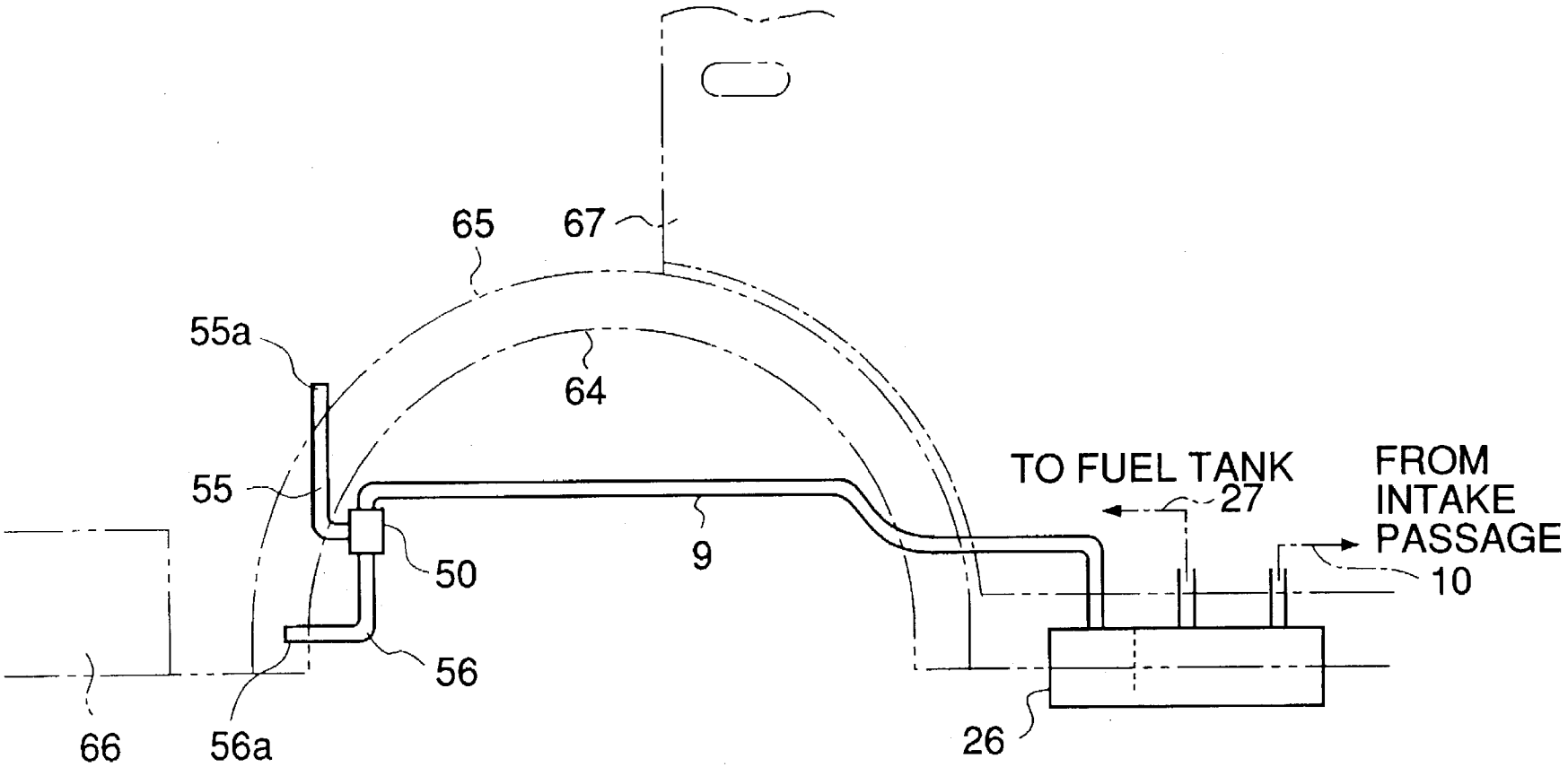
FIG. 3 is a schematic view showing the arrangement of essential parts of the evaporative fuel-processing system mounted in a chassis of the automotive vehicle.

FIG. 3 schematically shows the arrangement of essential parts of the evaporative fuel-processing system mounted in a chassis of the vehicle. In the figure, elements and parts appearing in FIG. 1 are designated by identical reference numerals, description of which is omitted.

In FIG. 3, reference numerals 64, 65, 66, and 67 designate component parts of the chassis of the vehicle, i.e. 64 designates a rear fender of the vehicle, 65 a rear wheel house of the chassis, 66 a bumper of the vehicle, and 67 a rear door of the chassis, respectively.

The canister 26 is arranged under a rear body of the chassis at a location forward of the rear wheel house 65. The changeover valve mechanism 50 is located at a location inwardly adjacent a rear portion of the rear wheel house 65. The inlet passage 55 has a distal end 55*a* thereof opening into a space inwardly adjacent an upper rear portion of the rear wheel house 65, which communicates with the atmosphere. The outlet passage 56 has a distal end 56*a* opening into a space inwardly adjacent a lower rear portion of the rear wheel house 65, which communicates with the atmosphere.

Next, description will be made of how air is taken into and discharged from the evaporative fuel-processing system constructed as above, through the passage arrangement close to the atmosphere.

When evaporative fuel generated in the fuel tank 23 is supplied in large amounts into the canister 26, the one-way valve 58 opens due to increased pressure within the chamber 52, and air containing evaporative fuel discharged from the air communication port 25 passes through the drain passage 9, the chamber 52, the open one-way valve 58, and the chamber 53, and discharged through the distal end 56*a* of the outlet passage 56 into the space inwardly adjacent the lower rear portion of the rear wheel house 65. Therefore, even if evaporative fuel is temporarily generated in the fuel tank 23 in such a large amount as exceeds the adsorbing capacity of the canister 26, e.g. in summer, part of evaporative fuel which is not adsorbed by the canister 26 is discharged through the above-mentioned discharge system into the space inwardly adjacent the lower rear portion of within the rear wheel house 65.

To desorb the evaporative fuel from the canister 26, the purge control valve 36 is opened in response to a driving signal from the ECU 6, to thereby allow evaporative fuel to be purged from the canister 26 via the purging passage 10 to the engine 1. Accordingly, the pressure within the chamber 52 lowers so that the one-way valve 57 opens. Then, air is drawn from the space inwardly adjacent the upper rear portion of the rear wheel house 65 by way of the distal end 55*a* of the inlet passage 55, and then introduced through the inlet passage 55, the one-way valve 57, the chamber 52, and the drain passage 9, into the canister 26.

When evaporative fuel generated in the fuel tank 23 is adsorbed by the canister 26, even if the one-way 57 is clogged with mud or the like, the opening area of the one-way valve 57 has a portion which is not closed by the valve element 57*b* (see FIG. 2), which prevents the drain passage 9 from being completely clogged. As a result, it can be avoided that the pressure within the fuel tank 23 increases to cause evaporative fuel to be emitted through the filler cap of the fuel tank 23 into the atmosphere.

When evaporative fuel adsorbed by the canister 26 is desorbed, even if air drawn from the space inwardly adjacent the upper rear portion of the rear wheel house 65 contains dust or trash to clog the one-way valve 57, the opening area of the one-way valve 58 has a portion which is not closed by the valve element 58*b* (see FIG. 2), which prevents the drain passage 9 from being completely clogged. As a result, permanent communication of the canister 26 through the drain passage 9 with the atmosphere can be ensured, which enables purging of evaporative fuel into the intake system together with air drawn through the one-way valve 57.

Although in the present embodiment, the open projections 57*a* and 58*a* communicate with the chambers 52 and 53 through openings defined at the opposite lateral side edges of the respective valve elements 57*b* and 58*b*, this is not limitative. Alternatively, holes may be formed through central portions of the respective valve elements such that the open projections 57*a* and 58*a* communicate with the respective chambers 52 and 53 through the holes.

Figure 4:
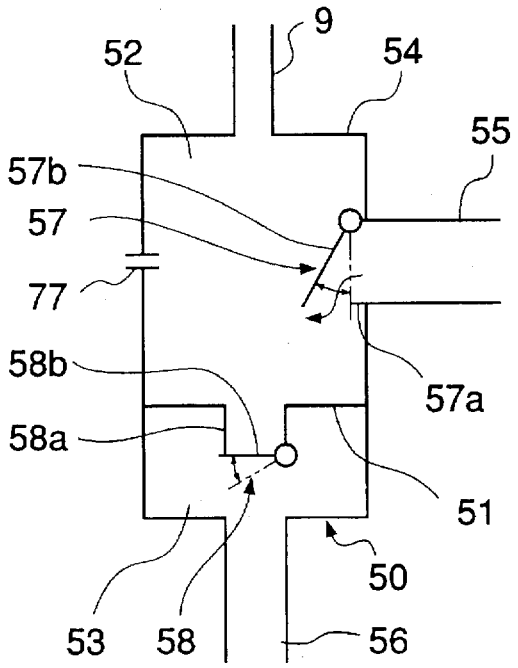
FIG. 4 is a view showing a changeover valve mechanism in an evaporative fuel processing system according to a second embodiment of the invention.

Next, a second embodiment of the invention will be described with reference to FIG. 4. FIG. 4 shows the construction of a changeover valve mechanism of the evaporative fuel-processing system according to the present embodiment. In the figure, elements and parts corresponding to those in the first embodiment are designated by identical reference numerals, description of which is omitted.

The changeover valve mechanism according to the second embodiment is different from the changeover valve mechanism according to the first embodiment in that the open projections 57*a* and 58*a* in the second embodiment are fully closed by the respective valve elements 57*b* and 58*b*, as in the prior art, while the open projections 57*a* and 58*a* in the first embodiment are partially closed, and according to the second embodiment, an air relief port 77 is formed through one side wall of the valve casing 54 such that the chamber 54 permanently communicates with the atmosphere through the port 77.

With the formation of the air relief port 77, even if at least one of the one-way valves 57 and 58 is clogged with mud or the like, permanent communication of the chamber 54 with the atmosphere through the air relief port 77 prevents the drain passage 9 from being completely clogged, to thereby always ensure the communication through the drain passage 9.

Next, a third embodiment of the invention will be described with reference to FIG. 5

Figure 5:
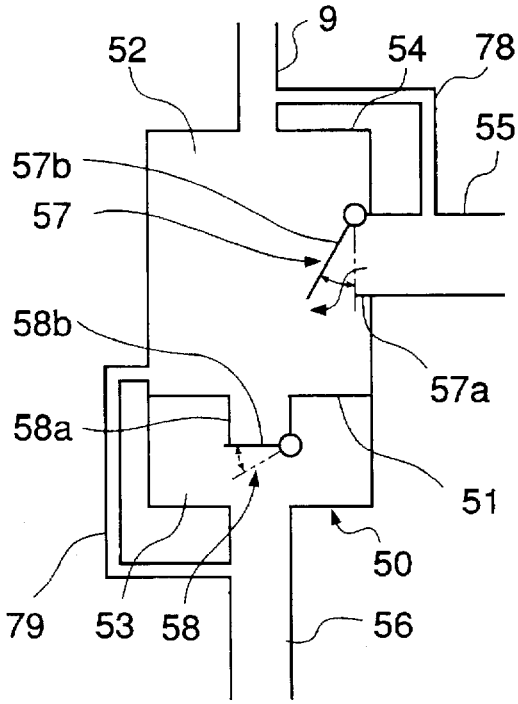
FIG. 5 is a view showing a changeover valve mechanism in an evaporative fuel processing system according to a third embodiment of the invention.

FIG. 5 shows the construction of a changeover valve mechanism of the evaporative fuel-processing system according to the third embodiment. In the figure, elements and parts corresponding to those in the first embodiment are designated by identical reference numerals, description of which is omitted.

The changeover valve mechanism according to the third embodiment is different from the changeover valve mechanism according to the first embodiment in that the open projections 57*a* and 58*a* in the third embodiment are fully closed by the respective valve elements 57*b* and 58*b*, as in the prior art, while the open projections 57*a* and 58*a* in the first embodiment are partially closed, and according to the third embodiment, a bypass pipe 78 extends between the drain passage 9 and the inlet passage 55 in a fashion bypassing the one-way valve 57, and a bypass pipe 79 extends the chamber 52 and the outlet passage 56 in a fashion bypassing the one-way valve 58.

With the provision of the bypass pipes 78, 79 even if at least one of the one-way valves 57 and 58 is clogged with mud or the like, the drain passage 9 can be prevented from being completely clogged, to always ensure the communication through the drain passage 9.

In the third embodiment, only one of the bypass pipes 78 and 79 may be formed and the other may be omitted.

Further, in the above described embodiments, in place of the one-way valves 58 and 59, electromagnetic valves may be employed to control opening/closing of the inlet passage 55 and outlet passage 56 in response to driving signals from the ECU 6.

What is claimed is:

1. An evaporative fuel-processing system for an internal combustion engine for use in a vehicle, said engine having an intake passage, and a fuel tank, comprising:

a passage extending between said fuel tank and said intake passage, for guiding evaporative fuel generated in said fuel tank, for processing;

a canister arranged across said passage, said canister having an air communication port;

a drain passage connected to said air communication port;

a valve casing connected to said drain passage;

a first passage connected to said valve casing;

a first valve associated with said first passage and said valve casing, for allowing air to flow into said canister through said first passage, said valve casing and said air communication port and for inhibiting evaporative fuel from being discharged from said canister through said air communication port, said valve casing and said first passage;

a second passage connected to said valve casing;

a second valve associated with said second passage and said valve casing, for inhibiting air from flowing into said canister through said second passage, said valve casing and said air communication port and for allowing evaporative fuel to be discharged from said canister through said air communication port, said valve casing, and said second passage; and bypass means for bypassing at least one of said first and second valves, said bypass means permanently communicating between said air communication port of said canister and the atmosphere.

2. An evaporative fuel-processing system as claimed in claim 1, wherein said first and second valves each have a valve element having opposite lateral side edges, said first and second passages each having an end thereof connected to said valve casing in a fashion being opened and closed by an associated one of said first and second valves, said bypass means comprising at least one gap defined between at least one of said opposite lateral side edges of said valve element of said at least one of said first and second valves and said end of at least one of said first and second passages that is associated with said at least one of said first and second valves.

3. An evaporative fuel-processing system as claimed in claim 1, wherein said first and second valves each have a valve element having opposite lateral side edges, said first and second passages each having an end thereof connected to said valve casing in a fashion being opened and closed by an associated one of said first and second valves, said bypass means comprising at least one notch formed in at least one of said opposite lateral side edges of said valve element of said at least one of said first and second valves.

4. An evaporative fuel-processing system as claimed in claim 1, wherein said first and second valves each have a valve element, said first and second passages each having an end thereof connected to said valve casing in a fashion being opened and closed by an associated one of said first and second valves, said bypass means comprising at least one hole formed through said valve element of said at least one of said first and second valves.

5. An evaporative fuel-processing system as claimed in claim 1, wherein said bypass means comprises a hole formed through said valve casing and communicating an inside of said valve casing with the atmosphere.

6. An evaporative fuel-processing system as claimed in claim 1, wherein said bypass means comprises at least one bypass pipe bypassing said at least one of said first and second valves.

7. An evaporative fuel-processing system as claimed in claim 1, wherein said valve casing has a partition member having an opening, and first and second chambers defined therein and partitioned by said partition member, said first passage having one end thereof opening into said first chamber, said second passage having one end thereof opening into said second chamber, said first valve being arranged at said one end of said first passage, said second valve being arranged at said opening of said partition member.

8. An evaporative fuel-processing system for an internal combustion engine for use in a vehicle, said engine having an intake passage, and a fuel tank, comprising:

a passage extending between said fuel tank and said intake passage, for guiding evaporative fuel generated in said fuel tank, for processing;

a canister arranged across said passage, said canister having an air communicating port;

a drain passage connected to said air communication port;

a valve casing connected to said drain passage;

a first passage connected to said valve casing;

a first valve associated with said first passage and said valve casing, for allowing air to flow into said canister through said first passage, said valve casing and said air communication port and for inhibiting evaporative fuel from being discharged from said canister through said air communication port, said valve casing and said first passage;

a second passage connected to said valve casing;

a second valve associated with said second passage and said valve casing, for inhibiting air from flowing into said canister through said second passage, said valve casing and said air communication port and for allowing evaporative fuel to be discharged from said canister through said air communication port, said valve casing, and said second passage; and bypass means for bypassing at least one of said first and second valves, wherein said first and second valves each have a valve element having opposite lateral side edges, said first and second passages each having an end thereof connected to said valve casing in a fashion being opened and closed by an associated one of said first and second valves, said bypass means comprising at least one gap defined between at least one of said opposite lateral side edges of said valve element of said at least one of said first and second valves and said end of at least one of said first and second passages that is associated with said at least one of said first and second valves.

9. An evaporative fuel-processing system for an internal combustion engine for use in a vehicle, said engine having an intake passage, and a fuel tank, comprising:

a passage extending between said fuel tank and said intake passage, for guiding evaporative fuel generated in said fuel tank, for processing;

a canister arranged across said passage, said canister having an air communicating port;

a drain passage connected to said air communication port;

a valve casing connected to said drain passage;

a first passage connected to said valve casing;

a first valve associated with said first passage and said valve casing, for allowing air to flow into said canister through said first passage, said valve casing and said air communication port and for inhibiting evaporative fuel from being discharged from said canister through said air communication port, said valve casing and said first passage;

a second passage connected to said valve casing;

a second valve associated with said second passage and said valve casing, for inhibiting air from flowing into said canister through said second passage, said valve casing and said air communication port and for allowing evaporative fuel to be discharged from said canister through said air communication port, said valve casing, and said second passage; and bypass means for bypassing at least one of said first and second valves, wherein said first and second valves each have a valve element having opposite lateral side edges, said first and second passages each having an end thereof connected to said valve casing in a fashion being opened and closed by an associated one of said first and second valves, said bypass means comprising at least one notch formed in at least one of said opposite lateral side edges of said valve element of said at least one of said first and second valves.

10. An evaporative fuel-processing system for an internal combustion engine for use in a vehicle, said engine having an intake passage, and a fuel tank, comprising:

a passage extending between said fuel tank and said intake passage, for guiding evaporative fuel generated in said fuel tank, for processing;

a canister arranged across said passage, said canister having an air communicating port;

a drain passage connected to said air communication port;

a valve casing connected to said drain passage;

a first passage connected to said valve casing;

a first valve associated with said first passage and said valve casing, for allowing air to flow into said canister through said first passage, said valve casing and said air communication port and for inhibiting evaporative fuel from being discharged from said canister through said air communication port, said valve casing and said first passage;

a second passage connected to said valve casing;

a second valve associated with said second passage and said valve casing, for inhibiting air from flowing into said canister through said second passage, said valve casing and said air communication port and for allowing evaporative fuel to be discharged from said canister through said air communication port, said valve casing, and said second passage; and bypass means for bypassing at least one of said first and second valves, wherein said first and second valves each have a valve element, said first and second passages each having an end thereof connected to said valve casing in a fashion being opened and closed by an associated one of said first and second valves, said bypass means comprising at least one hole formed through said valve element of said at least one of said first and second valves.

* * * * *